US006098533A

United States Patent [19]

Polloni et al.

[11] Patent Number: 6,098,533

[45] Date of Patent: Aug. 8, 2000

[54] CONVEYOR FOR STABILIZING PACKETS OF CIGARETTES COMING OFF A PACKING MACHINE

[75] Inventors: Roberto Polloni, Modigliana; Lorenzo Cocchi, Bologna; Fiorenzo Draghetti, Medicina, all of Italy

[73] Assignee: G. d. Societa per Azioni, Bologna, Italy

[21] Appl. No.: 09/325,066

[22] Filed: Jun. 2, 1999

[30] Foreign Application Priority Data

Jun. 3, 1998 [IT] Italy ..... BO98A0350

[51] Int. Cl.[7] ..... B41F 1/07; B23K 26/00; A24C 1/38

[52] U.S. Cl. ..... 101/3.1; 219/121.6; 219/121.7; 219/121.71; 219/121.82; 131/281

[58] Field of Search ..... 101/3.1, 26, 27, 101/32, 483; 219/121.6, 121.61, 121.62, 121.67, 124.7, 121.71, 121.82; 131/281

[56] References Cited

U.S. PATENT DOCUMENTS

| | | | |
|---|---|---|---|
| 4,263,766 | 4/1981 | Baker et al. | 101/27 |
| 4,911,302 | 3/1990 | Butler | 428/357 |
| 4,916,272 | 4/1990 | Okumoto et al. | 219/121.7 |
| 5,179,965 | 1/1993 | Komori | 219/121.7 |
| 5,186,184 | 2/1993 | Aindow et al. | 219/121.7 |
| 5,367,144 | 11/1994 | Matsumura et al. | 219/121.7 |
| 5,404,889 | 4/1995 | Belvederl et al. | 219/121.7 |
| 5,628,162 | 5/1997 | Kreosch et al. | 198/348 |

FOREIGN PATENT DOCUMENTS

| | | |
|---|---|---|
| 1293110 | 10/1972 | United Kingdom . |
| 2255321 | 11/1992 | United Kingdom . |

*Primary Examiner*—Eugene H. Eickholt
*Attorney, Agent, or Firm*—Ladas & Parry

[57] ABSTRACT

A conveyor for stabilizing packets of cigarettes coming off a packing machine, whereby each packet is fed along a stabilizing path and through a marking station by a pair of opposite facing conveyor belts partly engaging respective opposite minor lateral surfaces of the packet; and a laser marking unit is mounted at the marking station to impress a progressive code on a portion, left exposed by the respective conveyor belt, of one of the minor lateral surfaces of the packet.

6 Claims, 3 Drawing Sheets

CONVEYOR FOR STABILIZING PACKETS OF CIGARETTES COMING OFF A PACKING MACHINE

The present invention relates to a conveyor for stabilizing packets of cigarettes coming off a packing machine.

BACKGROUND OF THE INVENTION

On certain packing lines for producing packets of cigarettes, each packet is marked with a code indicating, for example, the date of manufacture and/or the plant at which the packet was produced.

Packets of cigarettes are normally in the form of a rectangular parallelepipedon comprising a pair of opposite major lateral surfaces, a pair of opposite minor lateral surfaces, a bottom surface, and an opposite top surface; and each packet is normally marked on a portion of the bottom surface or a portion of one of the minor lateral surfaces.

SUMMARY OF THE INVENTION

It is an object of the present invention to provide a straightforward, low-cost conveyor for stabilizing packets of cigarettes coming off a packing machine, and which provides for marking each packet rapidly and accurately on an end portion of a minor lateral surface of the packet.

According to the present invention, there is provided a conveyor for stabilizing packets of cigarettes coming off a packing machine, each said packet being substantially in the form of a rectangular parallelepipedon and comprising a pair of opposite minor lateral surfaces; the conveyor comprising two opposite facing conveyor belts for engaging respective said minor lateral surfaces of said packets and feeding said packets along a stabilizing path; and being characterized in that at least one of said two belts engages a first portion of each respective said minor lateral surface, and leaves a second portion of said minor lateral surface exposed; the conveyor comprising a marking station located along said stabilizing path and in turn comprising a laser marking unit for impressing a code on at least one said second portion of each said packet.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
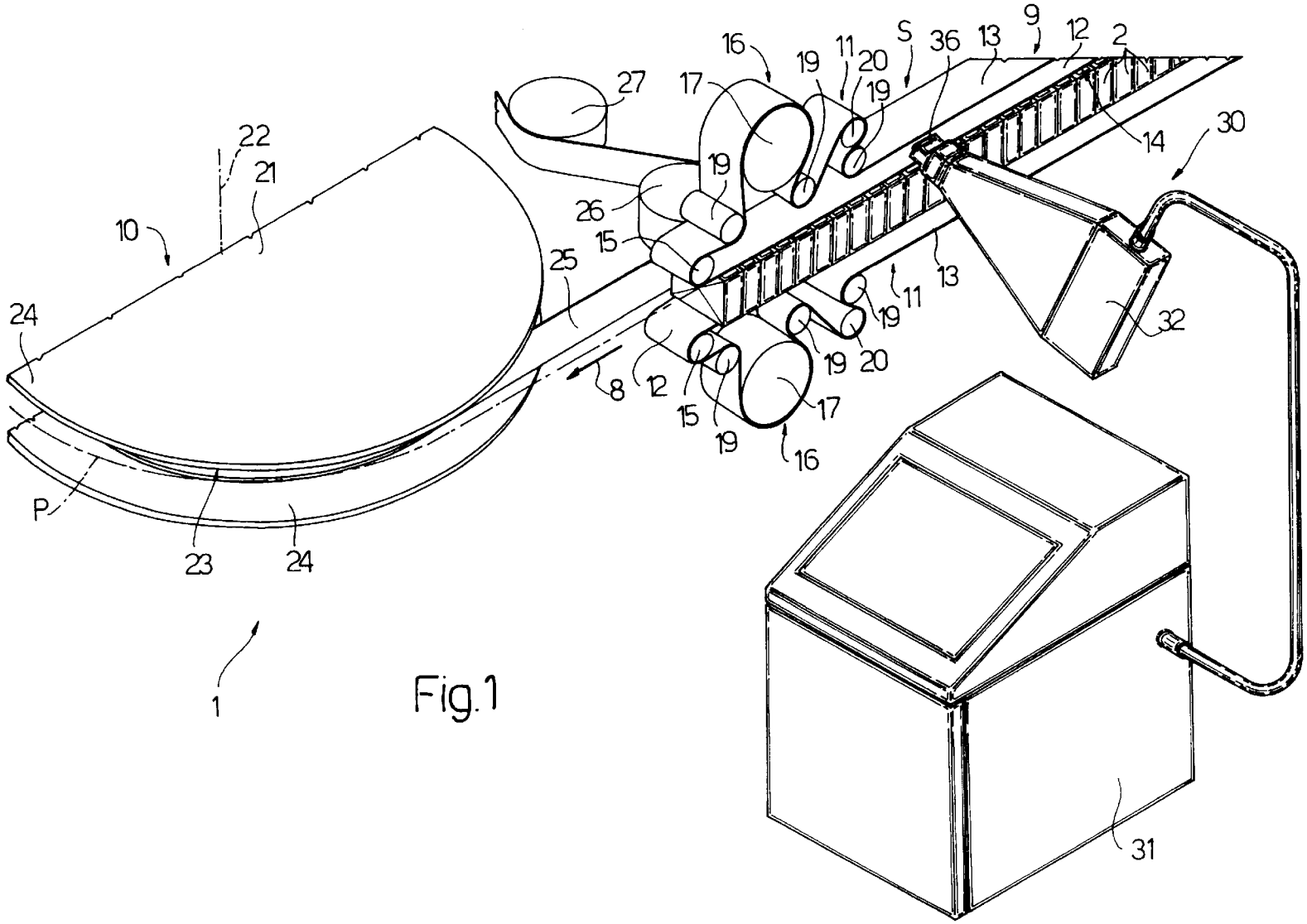
FIG. 1 shows a schematic view in perspective, with parts removed for clarity, of a preferred embodiment of the conveyor according to the present invention.

Number 1 in FIG. 1 indicates as a whole a conveyor for stabilizing packets 2 of cigarettes coming off a known packing machine not shown. Conveyor 1 provides for feeding packets 2 successively along a stabilizing path P (shown partly in FIG. 1) extending between an output O (FIG. 3) of the packing machine and a transfer conveyor T (FIG. 3) for transferring the packets to a known overwrapping machine not shown.

Figure 2:
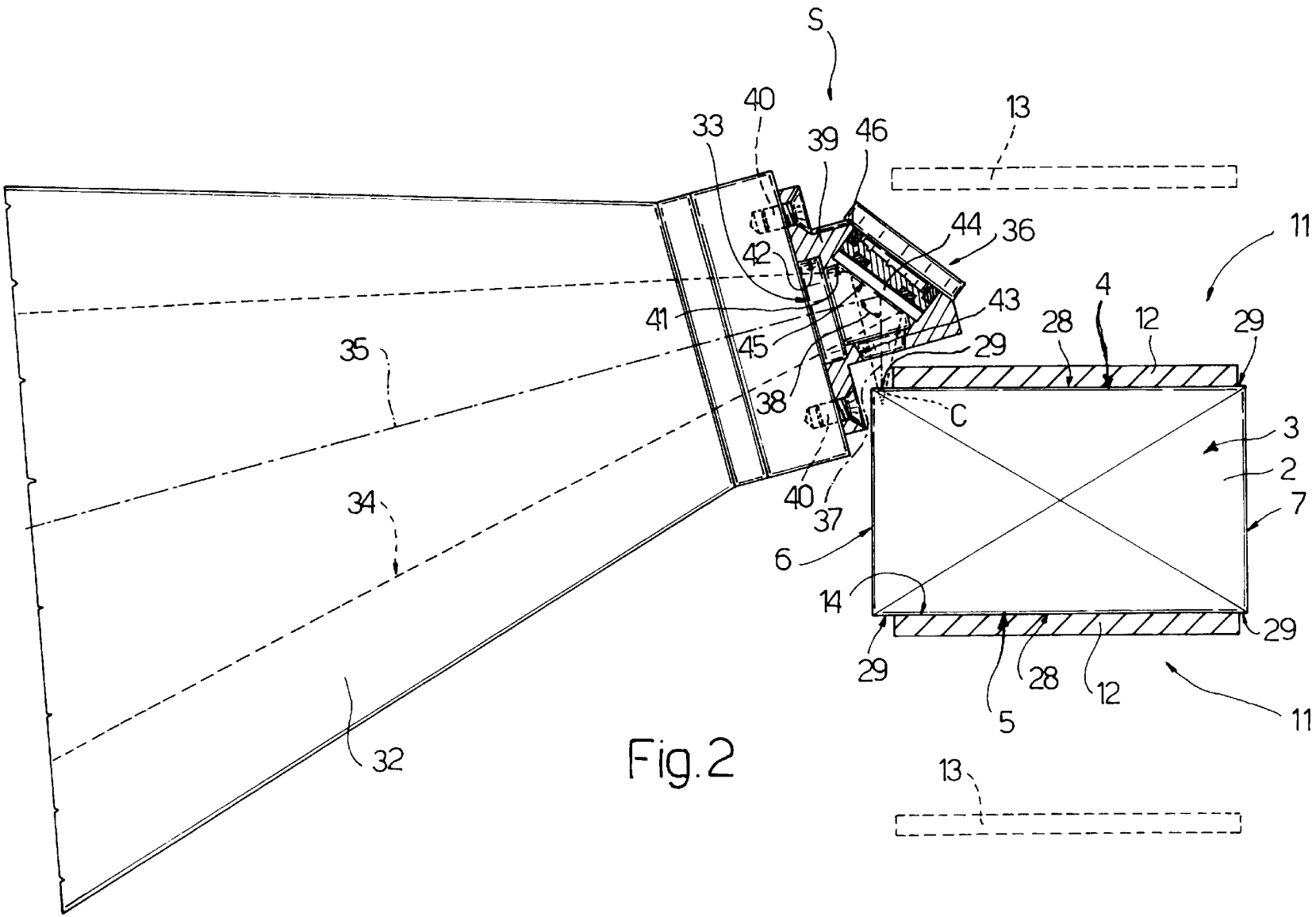
FIG. 2 shows a larger-scale, partially sectioned view, with parts removed for clarity, of a detail in FIG. 1.

As shown in FIGS. 1 and 2, each packet 2 is in the form of a rectangular parallelepipedon comprising a pair of opposite major lateral surfaces 3 (only one shown in FIG. 2), a pair of opposite minor lateral surfaces 4 and 5, a bottom surface 6, and an opposite top surface 7.

Packets 2 are fed successively onto conveyor 1 at an input station Sl, and are fed along path P at a given substantially constant speed and in a direction 8 crosswise to major lateral surfaces 3.

Conveyor 1 extends in a substantially horizontal plane, is substantially U-shaped, and is defined by two parallel, substantially straight end portions 9 connected by a curved intermediate portion 10.

As shown in FIG. 1, each portion 9 comprises two endless conveyor belts 11 (shown partly) having respective forward branches 12 facing and parallel to each other, and respective return branches 13, each of which faces and is parallel to the respective forward branch 12. Forward branches 12 travel in direction 8 at said given speed, and define between them a straight channel 14 of a width, measured between facing branches 12, substantially equal to the width of packets 2 measured between opposite minor lateral surfaces 4 and 5.

Each conveyor belt 11 is looped about two respective end pulleys 15 (only one shown), and comprises, close to one of pulleys 15, an activating assembly 16 in turn comprising a drive pulley 17 with an axis perpendicular to portions 9, two guide pulleys 19 on either side of pulley 17, a tensioning pulley 20, and a further guide pulley 19.

Intermediate portion 10 (known) is shown partly and schematically in FIG. 1, and comprises a conveyor drum 21 mounted for rotation about an axis 22 perpendicular to the conveyor 1 plane, and having a peripheral channel 23 defined between two annular flanges 24 of drum 21 and of substantially the same width as channels 14.

Channel 23 comprises a known suction device (not shown) for retaining packets 2 in opposition to the centrifugal force produced, and is engaged by a belt 25, which is permeable to air, is driven by the rotation of drum 21, and is looped about a pair of transmission pulleys 26 (only one shown) and a tensioning pulley 27.

Drum 21 is connected to a known drive device (not shown) for rotating drum 21 about axis 22 at such a rotation speed as to feed belt 25 at the same traveling speed as conveyor belts 11.

As shown clearly in FIG. 2, each conveyor belt 11 is narrower than the width of minor lateral surfaces 4 and 5 measured between bottom surface 6 and top surface 7, so that each conveyor belt 11 engages a portion 28 of a respective minor lateral surface 4 or 5, and leaves at least one portion 29 of minor lateral surface 4 or 5 exposed. In particular, and as shown in FIG. 2, each belt 11 engages a central portion 28 and leaves two end portions 29 of each respective minor lateral surface 4 or 5 exposed.

Conveyor 1 also comprises a marking station S located along a straight portion 9 of path P and in turn comprising a laser marking unit 30 for impressing a code C on an end portion 29 of minor lateral surface 4 of each packet 2.

Figure 3:
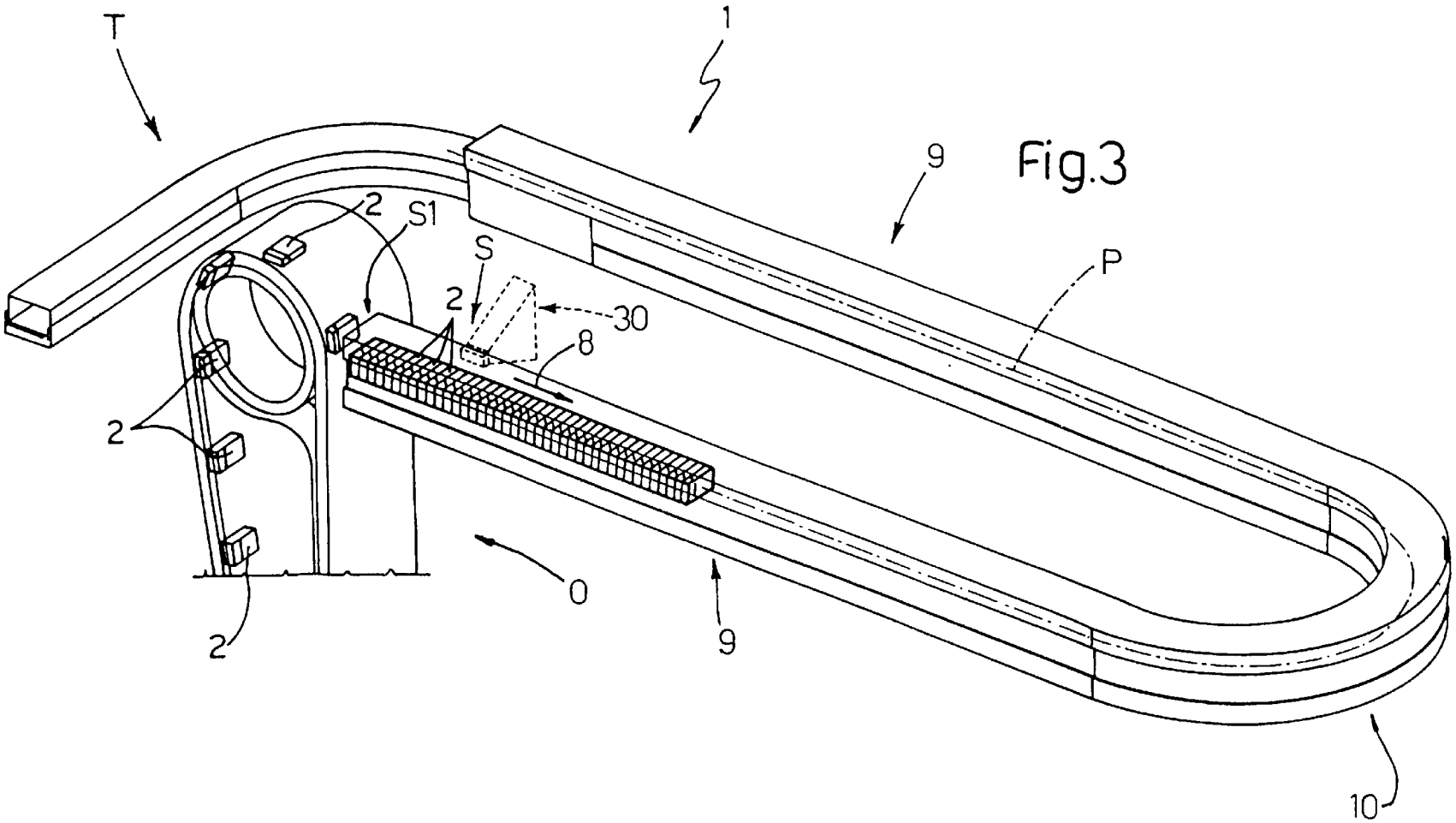
FIG. 3 shows a further schematic view in perspective of the FIG. 1 conveyor.

As shown in FIG. 3, marking unit 30 is preferably located between the two end portions 9 so that marking station S is located along the initial portion 9.

Laser marking unit 30 comprises a control station 31; an emitting device 32 connected to station 31 and having an output 33 for a laser beam 34 polarized in a given direction 35; and a reflecting device 36 mounted at output 33 of emitting device 32 to intercept and deflect the polarized laser beam 34 onto said end portion 29 of surface 4 of packet 2 at station S and in a direction 37 perpendicular to forward branches 12 of belts 11 and forming a given angle 38 with direction 35.

As shown in FIG. 2, reflecting device 36 is located, at least partly, between the forward branch 12 and return branch 13 of the conveyor belt 11 engaging surface 4 on which code C is to be impressed.

Reflecting device 36 comprises a supporting body 39 fitted by two screws 40 to output 33 of emitting device 32; and a reflecting chamber 41 defined in body 39 and having an input conduit 42 and an output conduit 43 respectively parallel to direction 35 and direction 37.

Reflecting chamber 41 comprises a fixed reflecting body 44 having a specular reflecting surface perpendicular to a bisector of angle 38. Reflecting body 44 is fitted to supporting body 39 by a known adjustable fastening device 46 permitting fine adjustment of the position of reflecting body 44, and therefore of surface 45, when the machine is stopped.

Operation of conveyor 1, and in particular of laser marking unit 30, is self-explanatory from the foregoing description.

In various embodiments, the code c impressed by laser unit 30 on one of end portions 29 of each packet 2 may comprise an alphanumeric and/or a dot or bar code indicating a progressive identification number of each packet 2, or indicating the place and/or date of manufacture of packets 2.

What is claimed is:

1. A conveyor for stabilizing packets (2) of cigarettes coming off a packing machine, each said packet (2) being substantially in the form of a rectangular parallelepipedon and comprising a pair of opposite minor lateral surfaces (4, 5); the conveyor comprising two opposite facing conveyor belts (11) for engaging respective said minor lateral surfaces (4, 5) of said packets (2) and feeding said packets (2) along a stabilizing path (P); and being characterized in that at least one of said two belts (11) engages a first portion (28) of each respective said minor lateral surface (4, 5), and leaves a second portion (29) of said minor lateral surface (4, 5) exposed; the conveyor (1) comprising a marking station (S) located along said stabilizing path (P) and in turn comprising a laser marking unit (30) for impressing a code (C) on at least one said second portion (29) of each said packet (2).

2. A conveyor as claimed in claim 1, characterized in that said laser marking unit (30) comprises an emitting device (32) having an output (33) for emitting a laser beam (34) in a given first direction (35); and a reflecting device (36) mounted at said output (33) of the emitting device (32) to intercept said laser beam (34) and deflect the laser beam (34) onto each said second portion (29) in a second direction (37) forming a given angle (38) with said first direction (35).

3. A conveyor as claimed in claim 2, characterized in that said second portion (29) is an end portion of the respective said minor lateral surface (4, 5); the respective said belt (11) comprising a forward branch (12) engaging said first portion (28), and a return branch (13) parallel to and facing said forward branch (12); and said reflecting device (36) being located at least partly between said forward branch and said return branch (12, 13).

4. A conveyor as claimed in claim 2, characterized in that said reflecting device (36) comprises a fixed specular reflecting surface (45) perpendicular to a bisector of said angle (38).

5. A conveyor as claimed in claim 3, characterized in that said second direction (37) is perpendicular to said forward branch (12).

6. A conveyor as claimed in claim 1, characterized in that said path (P) comprises at least one straight portion (9); said marking station (S) being located along said straight portion (9).

* * * * *

UNITED STATES PATENT AND TRADEMARK OFFICE

CERTIFICATE OF CORRECTION

PATENT NO. : 6,098,533
DATED : August 8, 2000
INVENTOR(S) : Roberto Polloni, et al.

It is certified that error appears in the above-identified patent and that said Letters Patent is hereby corrected as shown below:

On the title page:

Item 73 Assignee name should read: G. D Societa Per Azioni

Signed and Sealed this

Twenty-second Day of May, 2001

*Attest:*

Nicholas P. Godici

NICHOLAS P. GODICI

*Attesting Officer*

*Acting Director of the United States Patent and Trademark Office*